United States Patent [19]

Liebowitz et al.

[11] 4,252,656

[45] Feb. 24, 1981

[54] FOAM CONDITIONER FOR FABRICS

[75] Inventors: Marvin Liebowitz, Edison; Neil M. McHugh, Bridgewater, both of N.J.

[73] Assignee: Colgate-Palmolive Company, New York, N.Y.

[21] Appl. No.: 888,712

[22] Filed: Mar. 21, 1978

Related U.S. Application Data

[63] Continuation of Ser. No. 692,061, Jun. 2, 1976, abandoned, which is a continuation of Ser. No. 535,726, Dec. 23, 1974, abandoned.

[51] Int. Cl.[3] ..... D06M 15/08; D06M 15/12

[52] U.S. Cl. ..... 252/8.8; 252/8.6; 252/307; 252/356; 252/357; 427/242

[58] Field of Search ..... 427/242; 252/90, 305, 252/356, 357, 8.8 A, 8.8 B, 8.8 F, 8.8 AI, DIG. 3, 307, 8.6; 260/2.5 N, 553 R

[56] References Cited

U.S. PATENT DOCUMENTS

| | | | |
|---|---|---|---|
| 3,073,794 | 1/1963 | Stoner | 252/305 X |
| 3,301,808 | 1/1967 | Mack, Jr. et al. | 252/305 X |
| 3,796,599 | 3/1974 | McLaughlin | 427/242 |
| 3,806,359 | 4/1974 | McLaughlin | 427/242 |
| 3,912,666 | 10/1975 | Spitzer et al. | 260/2.5 N |
| 3,965,015 | 6/1976 | Bauman | 260/553 R |

FOREIGN PATENT DOCUMENTS

| | | | |
|---|---|---|---|
| 47-43743 | of 1972 | Japan | 252/305 |
| 933486 | of 1963 | United Kingdom | 252/305 |

OTHER PUBLICATIONS

*McCutcheon's Detergents and Emulsifiers Annual* 1969, John W. McCutcheon, Inc., Morristown, N.J. 1969, p. 70.

*Primary Examiner*—Evan K. Lawrence
*Attorney, Agent, or Firm*—Norman Blumenkopf; Herbert S. Sylvester; Murray M. Grill

[57] ABSTRACT

A composition for conditioning fabrics in a laundry drier is contained in a pressurized dispensing container and is dispensed as a stable foam. The composition comprises, by weight, 0.2 to 10% of one or more of a group of polymeric conditioning agents, such as polyvinyl pyrrolidone; 1 to 25% of a softening agent, such as a betaine; 0.5 to 10% of foaming agent; 0.2 to 3% of foam stabilizer; 0.5 to 10% of humectant; 10 to 60% of water; and 10 to 80% of liquified gas propellant.

11 Claims, No Drawings

FOAM CONDITIONER FOR FABRICS

This is a continuation of application Ser. No. 692,061, filed June 2, 1976, abandoned, which in turn is a continuation of Ser. No. 535,726, filed Dec. 23, 1974, abandoned.

BACKGROUND OF THE INVENTION

This invention relates to the conditioning of fibrous materials and fabrics, such as those which are made of cotton, synthetic organic polymers or mixtures thereof. More specifically, it relates to the conditioning of such materials with preparations, desirably in stable foam form, which contain one or more of a group of particular polymeric conditioning agents. Preferably, such compositions also include at least one especially useful softening and/or anti-static agent, an anionic or nonionic detergent or a mixture of detergents of such type(s), water and liquefied gas propellant.

Fabrics, yarns, threads, other textiles and articles made from them, such as clothing and laundry, have been treated to impart desirable properties to them. Compositions for effecting such treatments, such as those incorporating softening and antistatic agents, have been produced in a wide variety of physical forms, including emulsions, sprays, solids, coated papers and fabrics, sponges and liquids and applications of such materials to textiles and articles made from textiles have been effected at a variety of temperatures and under different conditions so as to produce the best softening, anti-static, antibacterial and other desired properties in the treated articles.

Softening agents and anti-static materials have been deposited on laundry during rinse cycles and also while it is being washed in automatic washing machines and have been applied to tumbling laundry in automatic dryers. In U.S. patent applications Ser. No. 109,691, for Fabric Conditioning, by Roberts et al., filed in the U.S. Patent Office on Jan. 25, 1971 and Ser. No. 507,090 of the present inventors, filed Sept. 18, 1974 and in U.S. Pat. Nos. 3,822,145 and 3,826,682, of Liebowitz et al., there are described "aerosol" foams containing fabric conditioning materials intended for application to laundry being dried and tumbled in an automatic laundry dryer. In U.S. Pat. No. 3,822,145 the conditioning foam employed is a stable foam and contains a poly-lower alkylene, such as polyethylene. The disclosures of the mentioned applications and patents are hereby incorporated herein by reference. Although applicants and other workers in the Research and Development Department of their assignee company have previously discovered the usefulness of various conditioning compositions in foam form, suitably dispensed from a pressurized container for intended use in automatic laundry dryers, the present invention utilizes polymeric materials hitherto unknown for this purpose.

SUMMARY OF THE INVENTION

In accordance with the present invention there is provided, for use in a a method of softening fibrous materials in a laundry drier, a source of a conditioning compound selected from the group consisting of polyvinyl pyrrolidone, polyvinyl pyrrolidone-vinyl acetate copolymers, quaternized vinyl pyrrolidone copolymers, polyethylene maleates, complex polyethoxy phosphate esters, polyethylene imines, aminopolyureas and cationic polyglucosides and mixtures thereof, so as to transfer to surfaces of the fibrous materials a conditioning quantity of such conditioning agent. The invention especially relates to stable foams for conditioning fabrics and to fabrics conditioning compositions in pressurized dispensing containers, pressurized by a liquefied gas or pressurized gas sufficiently to produce in the container a dispensing and foaming pressure, so that the material discharged from the container will form such a stable foam, useful for softening fibrous materials contacted with it during tumbling, as in a laundry dryer. The compositions comprise, particular proportions of conditioning agent; softening agent, such as a betaine; anionic or nonionic detergent foaming agent, such as a lower alkanolamine soap; foam stabilizer; humectant; water; and halogenated lower hydrocarbon liquefied propellant.

DETAILED DESCRIPTION OF THE INVENTION

In the process of this invention the fibrous materials to be conditioned, usually the fabrics of laundry to be softened and/or made static-free, will be of cotton, nylon, polyester, acrylic, acetate or a mixture thereof, such as a cotton-polyester mixture, e.g., Dacron-cotton 60:40 blends. When it is treated soon after washing and during the drying process, usually after being spun-dried, as is preferred, the laundry will normally contain from 20 to 80% of water, often from 30 to 60% thereof. However, although it is highly preferred for the treatment to be effected when the laundry is damp, as described, and use of the known and available automatic laundry dryers is also preferable, other tumbling treatments of fabrics and fibers with the present conditioning materials is also feasible. Thus, they may be applied from solid deposits or bars or from impregnated papers or coatings on substrates, with the conditioning material being rubbed off onto the fabric in contact with it and thereby exerting a conditioning effect thereon. However, the presence of moisture on the fabrics, a humid atmosphere, heat and air blowing onto the surface of the tumbling fabrics or laundry and the source of conditioning material, all characteristic of automatic laundry dryer treatments, are highly preferred.

When utilizing an automatic laundry dryer, the speed of the drum thereof, which is inclined from the vertical, and is usually about horizontal, normally is in the 10 to 100 revolutions per minute range, most often from 10 to 60 r.p.m. and the drying air temperature is from room temperature to as high as about 100° C., usually from 40° to 90° C. and often from 40° to 70° C. Drying times will normally be from 5 minutes to an hour, usually being from 10 to 45 minutes and frequently being from 15 to 40 minutes. The time during which the conditioning agent is distributed over the laundry or tumbling fabrics from the source thereof, a "stable" foam, is normally from 30 seconds to ten minutes, preferably about one to five minutes and most preferably two to five minutes. After distribution of the conditioning material onto the tumbling fabrics tumbling and drying operations continue to the total times mentioned and within such periods the moisture on the fabrics, together with the moisture in the foam and the surface active agents therein, help to distribute the conditioning agent and other components of the foam more evenly over the charge of laundry. In such operation the conditioning agents utilized also assist in providing for even coverage of the materials being treated, without undesirable visible or invisible greasy or oily or water repellent spots or deposits.

After treatment of laundry or fabrics according to the invented method they are satisfactorily dried and soft to the touch, anti-static and of good appearance. The treated materials are not "waterproof", even after repeated treatments, with washings between, apparently because the polymers do not form objectionable build-ups, perhaps because they are satisfactorily removed or redistributed in subsequent washings.

The various polymeric conditioning agents utilized have the property of distributing themselves and other materials of the compositions over the fabrics of laundry in the tumbling drum to the desired extent during drum operation. The foam will not disappear too quickly (this might lead to irregular deposits on the fabrics) and will not persist beyond the drying cycle under laundry dryer conditions. The polymers give the compositions the desired balance of penetrating and distributing properties and also impart desired conditioning to the materials treated. Thus, normally at least 10% of the foam will still be visible after 30 seconds of tumbling and preferably even after two or three minutes of tumbling in the dryer. Passing this test qualifies the foam as a "stable" foam. However, it is usually also desirable for it to be completely distributed over the laundry within a ten minute period.

The various conditioning agents of this invention which are characterized as polymeric are of molecular weights and desired hydrophile:lipophile component ratios or balances, in the proportions utilized, so as to maintain the conditioning foams produced sufficiently dry in appearance and stable so that they maintain the foam form or at least a part thereof does so for the desired period while tumbling with laundry in an automatic laundry dryer, whereby the conditioning agent and other materials present in the foam are better distributed over the surfaces of the laundry. The molecular weight of the polymer will often be in the range from 500 to 10,000 and it is usually in the 1,000 to 5,000 range. To reach such weights chain lengths can be modified, depending on the properties of the particular material, and cross-linking can be present. For example, a strongly lipophilic polymeric conditioning agent may be desirably employed at a lower molecular weight than one which is of a hydrophilic nature; in most instances the more hydrophilic will be more readily deposited on the laundry and the speed of such depositing may often be decreased by further polymerization or cross-linking.

The vinyl pyrrolidone polymers have been discovered to be useful conditioning agents in the practice of the processes of the present invention. Polyvinyl pyrrolidone (PVP) is well known as a component of hair sprays and has been utilized as a thickener or suggested for such use in various cosmetic and detergent preparations. It and the polyvinyl pyrrolidone-vinyl acetate copolymers (PVP/VA), both of which are known film-forming polymers, are manufactured by GAF Corporation. Also manufactured by that company and useful as a conditioning agent in the present compositions and processes are the quaternized vinyl pyrrolidone copolymers, such as those based on about 70 to 85%, e.g., 80%, of vinyl pyrrolidone and 15 to 30%, e.g., 20%, of dimethylaminoethyl methacrylate. Because of their quaternary structure such materials exert additional softening and anti-static properties when utilized in accordance with the present invention. Such quaternized vinyl pyrrolidone copolymers are sold under the tradename Gafquat 755. The molecular weights of the foregoing polymeric materials are known and it is usually preferred to utilize those which are of weights within the ranges previously given, e.g., 2,500.

Exemplary of the polyethylene maleates are the lower alkyl polyethylene maleates, such as those wherein the alkyl is of 3 to 5 carbon atoms, e.g., n-butyl polyethylene maleate, which may be considered as the half butyl ester of ethylene maleic anhydride. The polyethylene maleates are manufactured by Monsanto Corporation and are sold under the tradename EMA 1325. The complex polyethoxy phosphate esters are either monoesters or diesters and preferably are mixtures thereof, wherein the proportion of monoester to diester is in the range of 1:10 to 10:1. Such materials, which usually have molecular weights in the ranges previously given, may be of the formulas

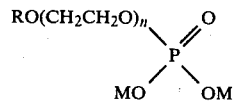

and

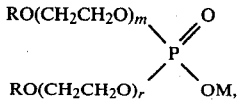

wherein R is a lipophilic group, usually higher alkyl or alkyl phenyl, of 10 to 20 carbon atoms (and sometimes more), M is hydrogen, alkali metal, lower alkanolamine or similar salt-forming material and n (or m+r) is an integer large enough to result in the molecular weight of the polymer being in a range described. The complex organic phosphate esters are manufactured by GAF Corporation and sold are under the trademarks Gafac ACRS 610 and Gafac RO 310.

The polyethylene imines and the aminopolyureas employed are polymers of known structure and of the desired molecular weight to obtain the effects previously disclosed. The polyethylene imines possess a reactivity with cellulosic materials and thereby may chemically join to them to promote conditioning. The cationic polyglucosides or other suitable glycosides which may be used in replacement of them in whole or in part under suitable circumstances are glucosides (or glycosides) having cationic groups joined to the polymeric chain, as in replacement of hydroxyls thereof. An example of such suitable conditioning agents for use in the present invention is NSR 78-1568, manufactured by National Starch Company. The cationic groups include amino and quaternary nitrogen-containing moieties.

The propellant employed may be of any suitable type for the purpose, to pressurize the container sufficiently so as to permit discharge of the contents thereof upon opening of a dispensing valve and to provide a dispersed phase to produce the desired stable foam. Thus, the compressed gases may be employed, such as nitrogen, carbon dioxide, nitrous oxide and air but usually the liquefied gases, which may also act as solvents for the medium to be discharged, are preferred. These will usually be organic compounds, generally lipophilic in nature and low boiling and normally are liquids when at or near ambient temperatures and under pressure.

The liquefied gases will preferably be cyclic or acyclic lower chlorocarbons, fluorocarbons, chloro-fluorocarbons or hydrocarbons of carbon atom contents of 1 to 4. Although such compounds may contain free hydrogen atoms the best of them are saturated and some are completely halogenated, normally including fluorine or fluorine and chlorine. Examples of suitable propellants are those commercial products known as Propellants 11 (trichloromonofluoromethane), 12 (dichlorodifluoromethane), 14 (carbon tetrafluoride), 21 (dichloromonofluoromethane), 22 (monochlorodifluoromethane) and 114 (dichlorotetrafluoroethane). The numbers of these propellants correspond to the numbers of Freon propellants manufactured and sold by E. I. DuPont # Co., where Freon is the trademark for a group of fluorochloromethanes and ethanes. Among the most useful of the liquefied gas propellants are dichlorodifluoromethane, monofluorotrichloromethane, dichlorotetrafluoroethane, octafluoropropane, octafluorocyclobutane, propane, butane, isobutane, cyclobutane, methylene chloride and tetrafluoromethane. The propellants will usually be employed in mixtures, with the mixture being such as to generate a pressure in a gas-tight container of about 10 to 100 lbs. per square inch gauge, preferably from 20 to 70 lbs./sq. in. gauge at 70° F. (corresponding to 1.7 to 8 atmospheres absolute pressure, preferably from 2.4 to 5.8 atmospheres abs. at 21° C.). They will also be chosen for compatibility with the rest of the formula and for their usefulness in assisting to maintain the stabilities of the foam generated. If flammable propellants are present, considering that the present products are preferably employed in conjunction with laundry dryers, they will usually be formulated with non-flammable materials or other propellants such as to avoid any danger of combustion in normal use. In preferred propellant formulations there will usually be employed from 10 to 90% of a "higher pressure" propellant and from 90 to 10% of a "diluent" propellant and more preferably, such ratios will be from 70 to 30% of the higher pressure propellant and 30 to 70% of the low pressure diluent. For example, 60 parts of dichlorodifluoromethane may be used with 40 parts of dichlorotetrafluoroethane to make a propellant or liquefied gas portion of a conditioning composition.

Foams may be made without water but in the present invention such foams are not as useful as those which contain some water, which assists in the formation of desirable and stable emulsions or other dispersions of the conditioning materials present in the formula, including the conditioning agent, and also assists in helping to distribute the conditioning agent and other components of the present foams over the damp laundry or fabrics with which it is brought into tumbling contact. The water employed in the conditioning compositions is preferably deionized or of low hardness, under 50 parts per million of hardness, calculated as calcium carbonate. It will usually be undesirable for it to contain dissolved salts to an extent of more than 0.1%.

While the polymeric materials can form foams when discharged from pressurized containers, normally better foams are made when a foaming agent, such as a suitable surface active agent or detergent, is present. Various anionic and nonionic materials are suitable for this purpose, with the anionics being preferred. Lengthy descriptions of such compounds may be found in the texts, *Surface Active Agents and Detergents,* Volumes I and II, by A. M. Schwartz, J. W. Perry and J. Berch, published in 1958 by Interscience Publishers, Inc., and *Detergents and Emulsifiers* 1969 *Annual,* by John W. McCutcheon, incorporated herein by reference, but nevertheless a listing of some such representative compounds will be given.

The anionic surface active agents include the sulfuric reaction products having a higher alkyl or acyl radical therein. Some of these are: the higher alkyl benzene sulfonates, preferably with the alkyls being linear; N-higher acyl sarcosides; alpha-olefin sulfonates; paraffin sulfonates; higher fatty acyl taurides and isethionates; higher fatty acid monoglyceride sulfates and sulfonates; and more specifically, tallow alcohol sulfate, coconut oil monoglyceride sulfate and n-dodecyl benzene sulfonate, as the sodium, potassium and triethanolamine salts. Normally the anionic surface active materials will have approximately balanced hydrophile-lipophile ratios and the higher alkyl or acyl will be of 10 to 20 carbon atoms, preferably 12 to 18 carbon atoms.

Among the preferred nonionic surfactants and detergents are the polyoxy-lower alkylene higher alkyl ethers, e.g., polyoxyethylene lauryl ether having four ethoxy groups (Brij 30); middle alkyl phenoxy poly(-lower alkoxy) lower alkanols, e.g., nonyl phenoxy polyethoxy ethanol (Igepal CO 880); and balanced hydrophilic-lipophilic compounds made by the condensation of lower alkylene oxides with organic hydrophobic materials, e.g., Pluronics F-68 and L-44. Most of the useful nonionic compounds include lipophilic groups having higher alkyl or alkyl phenyl components, generally of 8 to 20 carbon atoms, and hydrophilic components which are poly-lower alkylene oxides of 4 to 100 moles of lower alkylene oxide per mole of compound. Preferred lower alkylene oxides are those of 2 to 3 carbon atoms, most preferably, ethylene oxide. In addition to aiding emulsification and/or foaming of the present compositions both the anionic and nonionic surface active materials often possess softening and/or anti-static activities so that they also contribute to the desired properties of the foams produced.

The lower alkanolamine higher fatty acid soaps are the most most useful of the anionic detergents (which term includes soap) for the purpose of producing the desired foaming characteristics in the present compositions upon dispensing them from pressurized containers through discharge valves. These are usually soaps in which the lower alkanol is of 1 to 5 carbon atoms, preferably 1 to 3 carbon atoms and most preferably is ethanol. The higher fatty acid portion of the molecule is of 10 to 20 carbon atoms and is preferably of 16 to 20 carbon atoms, with the 16 to 18 carbon atoms range being most preferred. The best embodiment of the fatty acid moiety of the alkanolamine soap is commercial stearic acid, double pressed, comprising stearic, palmitic and oleic acids, or triple pressed stearic acid, comprising stearic and palmitic acid. Of course, the pure stearic or palmitic acids may be employed, if the cost thereof is not a serious detriment. The alkanolamines of the alkanolamine soaps may be mono-, di- or trialkanolamines and of these, the trialkanolamines are most preferred. Generally, they are of the same alkanol radicals but mixed alkanolamines are also used. Instead of the alkanolamines in some cases the lower alkyl amines may be employed, usually in mixture with the alkanolamines. Examples of the alkanolamine soaps are the most preferred triethanolamine stearate, triethanolamine palmitate, triethanolamine tallowate, triisopropanolamine cocate, tri-t-butanolamine laurate, diethanolamine stearate and monoisopropanolamine palmitate. The ordinary higher ($C_{10}$–$C_{20}$) fatty acid soaps of alkali metals, such as sodium and potassium and the alkaline earth metals, such as calcium, as well as ammonium and magnesium soaps, may be used alone or in mixture, together with the alkanolamine soaps but the proportions thereof will normally be held to less than 30% of the total higher fatty acid soap content, for best results.

Amine oxides, usually higher alkyl di-lower alkyl amine oxides wherein the higher alkyl is of 8 to 20 carbon atoms, preferably of 12 to 18 carbon atoms and the lower alkyl is of 1–4 carbon atoms, preferably being methyl, may also be employed as supplementary conditioning agents which have distributing effects and contribute to non-staining properties of the composition in use.

With the present conditioning agent, propellant, water and surface active agent (these latter two components are preferably present) it is generally preferred to have present also a softening and/or anti-static agent of a type known to be effective in aerosol foam usages. Exemplary of such materials are the betaines, quaternary ammonium salts, lanolin, lanolin derivatives and polyethylenes and mixtures thereof. Most preferable of these in most compositions are the betaines which, although normally not expected to be as effective as the quaternaries, in the present compositions and with the alkanolamine soaps appear to be especially effective and have the additional advantage of not causing any staining or greasy feel of the materials treated (the quaternary ammonium halide salts sometimes do cause such staining, in the absence of the present conditioning agents). The betaines employed are preferably glycine derivatives, usually being either higher fatty alkyl di-lower alkyl glycines or higher fatty acyl amido-lower alkyl di-lower alkyl glycines but may also be similar derivatives of other amino acids like glycine. Normally the higher alkyls will be of from 10 to 20 carbon atoms and the lower alkyls will be of 1 to 4 carbon atoms with the most preferable higher alkyls and acyls being of about 12 carbon atoms, such as those obtained from coconut oil and the lower alkyls being methyl. For example, the coconut oil fatty alkyls amine of dimethyl glycine and coconut oil fatty acids amidopropyl dimethyl glycine are preferred examples of such softening agents.

The cationic softeners which may be used, especially in the present compositions wherein their tendency to stain fabrics when over-applied is mitigated by the presence of the conditioning agent, include primarily the quaternary ammonium salts, which normally will contain one or two higher alkyl or lipophilic groups, two or three lower alkyl or lesser lipophilic groups and a halogen or other suitable anion, such as chlorine or bromine, about a quaternary nitrogen. The higher alkyls will be of 10 to 20 carbon atoms, preferably 12 to 18 carbon atoms and the lower alkyls will be of 1 to 3 carbon atoms, preferably 1 or 2 carbon atoms. Examples of such softening agents include distearyl dimethyl ammonium chloride, cetyl trimethyl ammonium bromide, benzethonium chlorides, stearyl pyridinium bromides and imidazolinium methosulfates. The quaternary ammonium salts and glycine derivative softening agents are described in more detail in U.S. Pat. Nos. 3,826,682 and 3,822,145 and in U.S. patent application Ser. No. 109,691.

Lanolin and lanolin derivatives, especially the more hydrophilic derivatives thereof, are also useful in the present compositions and processes as softening agents. Lanolin is a mixture of cholesterol esters of higher fatty acids and it may be employed in either its hydrous or anhydrous form in the present compositions but it is preferably converted to a more hydrophilic derivative thereof by oxyalkation, acylation or a combination of these processes. Such conversions help to increase the ease of ultimate removal by washing of the lanolin derivatives from fabrics or materials onto which they are deposited and thereby, undesirable buildup is avoided. When the lanolin is not converted to a more hydrophilic form, as described, it is preferably employed with hydrophilic compounds or with other such materials which facilitate its release from treated fabrics during a subsequent washing operation. Among the more hydrophilic derivatives of lanolin which may be used are the alkoxylated lanolins, preferably lower alkoxylated and most preferably ethoxylated. The number of alkoxy groups is usually from 10 to 100, preferably from 25 to 100 and most preferably about 50 to 90 per mol. Such materials are waxy in form and possess dispersant, emulsifying and lubricating properties. They are obtainable from American Cholesterol Products, Inc., under the tradename Solulan, particularly as Solulans 25 and 75 and most preferably as Solulan 75 (the numerals indicate the degree of ethoxylation of these lanolin alcohols). Acetylated polyoxyethylene lanolin derivatives having 9 and 10 mols of ethylene oxide, respectively, per mol are sold under the tradenames Solulan 97 and Solulan 98, the former being completey acetylated and the latter being partially acetylated. Polyoxyethylene cholesterols, such as Solulan C-24, which contains 24 mols of ethylene oxide, normally contain 5 to 50 mols of lower alkylene oxides, preferably ethylene oxide.

Acylated lanolin alcohols such as the acetylated lanolin alcohols sold under the trade name Acetulan by American Cholesterol Products, Inc. may also be utilized. Further descriptions and examples of lanolins and derivatives thereof, such as those which are hereby characterized as acylated or polyethoxylated lanolins, are found in our U.S. patent application Ser. No. 296,336.

The last of the preferred softening agents are the polyethylenes, described in U.S. Pat. No. 3,822,145, of which the present inventors are co-inventors with Henry D. Cross III. Such polyethylenes or suitable poly-lower alkylenes will normally have a molecular weight less than 5,000, preferably from 1,000 to 3,000 and most preferably in the 2,000–2,200 range. Such weights are average molecular weights but it is usually preferred that substantially all (over 90%) of the polymer should be within at least one of such ranges. While the polyethylenes are preferred, the poly-lower alkylene may be a random or block copolymer of lower alkylene, such as one of 2 to 4 carbon atoms, but usually it will be of polypropylene or a polymer made from a mixture of ethylene and propylene, if polyethylene itself is not employed. When butylene or isobutylene is present it will normally be to a minor extent, generally from 1 to 20% of the weight of the polymer and when propylene is present it will be less than 40% of the polymer, e.g., 1 to 20%. Suitable examples of polyethylenes that are useful include that sold as Poly-Pel N-40 by Scher Brothers, Clifton New Jersey, which is in emulsion form, containing 32% of polyethylene of a molecular weight of 2,000, 8% of nonyl phenol polyethoxy ethanol (75% ethylene oxide) and 60% of water. While the softening agents described above are those considered most desirable for use with the present conditioning agents and while some of the softening agents may also possess conditioning properties, making them additionally useful, it is within the present invention to employ other softeners, too and to use them in mixture with the above described softeners. Also, in some preferred aspects of the present invention mixtures of the above described softening materials and mixtures within the classes described are utilized.

Small proportions of higher fatty acid lower alkanolamides, especially di-lower alkanolmides, also aid in conditioning and in producing and maintaining a stable foam. Such compounds are of higher fatty acids of 10 to 20 carbon atoms, preferably of 12 to 18 carbon atoms and most preferably of 12 to 14 carbon atoms, and of lower alkanols, such as those of 1 to 4 carbon atoms, especially ethanol and isopropanol. Examples of suitable alkanolamides include lauric myristic diethanolamide, the preferred compound; lauric diisopropanolamide; stearic monoethanolamide; myristic diethanolamide; palmitic monoisopropanolamide; and lauric dimethanolamide. Instead of the same alkanol being employed, different alkanols of the types mentioned may be used, as in lauric myristic ethanol isopropanolamide. The alkanolamides are especially useful for imparting anti-static effects to the laundry being treated.

It has been found that plasticizing, humectant or emollient type compounds such as a suitable dihydric, trihydric or polyhydric lower alkanols of 2 to 6 carbon atoms and 2 to 6 hydroxyls, e.g., glycols, glycerol, lower alkylene glycols, dialkylene glycols or polyalkylene glycols, such as propylene glycol, diethylene glycol, dipropylene glycol, polyethylene glycol, sorbitol and mannitol and equivalent such compounds and substituted derivatives thereof make satisfactory components of the present compositions and appear to toughen the stable foam produced, so as to make it better able to resist the shocks and forces encountered in tumbling with humid materials during the conditioning operation.

With the other constituents of the composition there may be present various adjuvants such as coloring agents (dyes and water dispersible pigments), perfumes, fluorescent dyes or optical brighteners, bactericides, fungicides, soil repellents, synthetic and natural gums and colloids, and solvents, all for their indicated functions. Usually, the total of such materials will be less than 20% of the composition weight and preferably, will be less than 5% thereof, with no material being present in an amount greater than 5%.

The proportions of the various components of the present pressurized compositions are essentially the same as those of the foams produced, allowing for some escape of the liquefied gas propellant, as will be described later. Of the pressurized composition (and the foam) the polymeric conditioning agent or a mixture of such agents will usually be from 0.2 to 10%, preferably 0.3 to 3% and more preferably 0.5 to 2%. The softening agent will normally be from 1 to 25% of the pressurized composition, preferably 8 to 20% and more preferably about 10 to 15% thereof while the content of anionic and/or nonionic detergent, preferably soap, will usually be 0.5 to 10%, preferably 1 to 5% and more preferably about 2 to 4%. The propellant, when it is a liquefied gas, normally constitutes from 10 to 80% of the product, preferably 30 to 70% and more preferably 40 to 60% thereof and the water content, when water is present, will generally be 10 to 60%, preferably 15 to 50% and more preferably 20 to 40%. The alkanolamide content is low, as a rule, usually being from 0.02 to 3%, preferably 0.05 to 1% and more preferably about 0.05 to 0.5%. The humectant or plasticizer content, e.g., glycerol content, will usually be from 0.5 to 10%, preferably 1 to 5% and more preferably 2 to 4%. The proportions of the various constituents recited will preferably be adjusted within the ranges described to obtain the most desirable stable foams, desired conditioning and softening agents, distribution of the product over the surfaces of tumbling laundry and non-staining characteristics.

The stable foams of this invention are made by discharging the pressurized composition to the atmosphere through an ordinary dispensing valve. Discharge may be very quick, usually occurring in less than ten seconds, and the foam produced, which is of essentially the same composition as the pressurized product before dispensing, with the propellant expanding to produce the foam, resists breakdown or drainage, even during use. The propellant almost completely volatilizes during dispensing, although a small proportion thereof, the lower pressure or "solvent" fraction, may be present as a liquid film in the foam, and some of the higher pressure propellant may escape. Thus, the foam will be constituted of all the original components except for a part of the propellant mixture, usually less than 20%, preferably less than 10%, which may be lost. For the purpose of this discussion, it will be considered that the composition of the foam is that of the pressurized product, although it will be recognized that there may be some losses of propellant, in which case the proportion of each constituent in the foam will be increased by the multiplier 100/100-X, wherein X is the percent of propellant lost in dispensing.

The present aerosol compositions are easily made and require no special procedures or apparatuses. If desired, the soaps and surface active agents may be made in situ or may be mixed with the rest of the ingredients, except for the propellants, and the compositions may subsequently be pressurized, usually by having the gaseous propellant added through a normally discharging valve. Generally, the initial mixing of the materials is at room temperature and in some cases the materials may first be warmed slightly, sufficiently to produce a homogeneous product. Also, instead of using pressure filling the "aerosol" product may be pressurized by adding refrigerated liquid propellant to a container, after which a dispensing valve is affixed and the container is sealed.

The triethanolamine stearate constituent may be made in situ by blending together and reacting triethanolamine and stearic acid before or when the composition is being formulated. With respect to heating to make the mixture homogeneous so as to promote in situ reactions of the types described, it will normally not be required to heat to a temperature greater than 50° C. and of course, in the presence of materials such as perfume and solvents, addition thereof will be at as low a temperature as feasible to avoid excessive evaporation losses, usually after completion of any in situ reactions and after cooling. The products may be made at various pH's but usually the pH will be from 6 to 10, preferably from 7 to 9 and most preferably from 7 to 8, at a one percent concentration in water.

To use the pressurized composition one needs only to press the discharge valve bottom of the aerosol dispenser to release the desired amount of conditioning foam. For best results the can should be shaken immediately after manufacture and also just before use to make such that the composition is uniform before dispensing. This also will prevent undesired increases in pressure due to separation of the propellant from the rest of the product. The foam may be discharged directly into the dryer onto fabrics or laundry to be conditioned, usually in a single "mass" or charge. It need not be first discharged externally of the dryer and then transferred to the fabrics but this is also possible. Tumbling of the laundry and the drying thereof may be commenced immediately after addition of the foam. Because the density of the foam will usually be about constant for a particular composition, the consumer can judge by volume or dispensing time when the appropriate amount of foam has been generated.

The amount of conditioning composition employed will usually be sufficient to provide about 0.05 to 1 gram of softener per pound of dry laundry and more preferably, about 0.1 to 0.5 gram per pound will be used. Thus, for the usual eight pounds of dry laundry in the dryer from 0.4 to 8 grams of softener will be employed, usually corresponding to from about 2 to 50 grams of the foam composition, preferably about 5 to 40 grams thereof. Such relatively small amounts are convenient to handle, pack and dispense, and with the usual aerosol container several applications are available from a single package. Of course, the amount to be employed will depend on the effectiveness of the particular softening composition being considered. The amounts of softening agent, conditioning agent, detergent, humectant, aklanolamide, water and liquefied gas present in the formula may be adjusted so as to allow for a certain desired number of uses for the product per container. Similarly, container size may be adjusted, e.g., from three ounces to two pounds per container.

The laundry treated will normally contain from 20 to 70%, most often from 30 to 60% of water, with the balance generally being of mixed cotton, cotton-polyester, nylon, acetate, acrylic and Dacron textiles. Although such materials may be treated with the present foams outside the automatic laundry dryer, conditioning in the dryer is much superior due to the tumbling effects, the wetness of the laundry, the humid atmosphere, the air blowing and the presence of heat in the dryer and therefore is highly preferred.

The present stable foams maintain their shapes indefinitely if not subjected to external forces. When added to the damp laundry in an automatic laundry dryer the foams are slowly abraded or worn down so that the softening materials in them are spread over the surfaces of the laundry. Thus, the foam is spread in thin films over the laundry and does not deposit greasy spots or stains thereon. For example, in a drum which may revolve at a speed of from 10 to 100 r.p.m., most often from 10 to 60 r.p.m., and with drying air at a temperature from room temperature as to high as about 100° C., most of the time at from 40° to 70° or 90° C., the present foams will preferably not be completely spread over the laundry within a three minute period. In other words, some of the foam will still be present in the dryer after this period of time and normally at least 10% of the formula will still be in such form. In some cases, the foam volume may be diminished to 10% of the original volume within 30 seconds and still good distribution will have been obtained. The good distribution is also attributable in part to the moisture of the fabric that is to be conditioned and the particular components of the foam, including the moisture therein which, in combination, spread the conditioning agent over the laundry, softening it and making it less likely to accumulate static charges when subjected to friction.

After treatment of the laundry according to the invention examination indicates no spotting, greasy or oily stains or other objectionable uneven distribution of the softening agent. The laundered items dried are soft and often are also anti-static, especially when alkanolamides are present in the formulations. They do not become "water-proofed", even after repeated treatments, apparently because the conditioning agent and any lipophilic materials are removed in subsequent washings, which removal is facilitated by the method of application to the laundry and the other compounds of the pressurized composition.

The following examples illustrate various embodiments of the invention. Unless otherwise indicated, all parts are by weight and all temperatures are in °C.

EXAMPLE 1

| | Parts |
|---|---|
| Coconut oil fatty alkyl dimethyl glycine | 12.9 |
| Triethanolamine stearate | 3.0 |
| Glycerol | 3.0 |
| Lauric myristic diethanolamide | 0.1 |
| Polyvinyl pyrrolidone (PVP) | 1.0 |
| Water, deionized | 30.0 |
| Propellant 12 | 30.0 |
| Propellant 114 | 20.0 |
| | 100.0 |

The triethanolamine stearate is made by reaction of stoichiometric proportions of triethanolamine and triple pressed stearic acid (it contains the expected proportion of triethanolamine palmitate) at an elevated temperature (about 50° C.), after which it is cooled to about 30° C. The coco dimethyl glycine softener, glycerine, lauric myristic diethanolamide and water are admixed with the triethanolamine stearate and the mixture is heated to about 40° C., at which temperature the polyvinyl pyrrolidone is dispersed in the aqueous medium. The PVP is obtained from GAF Corporation and the coco dimethyl glycine is that produced by Ashland Chemical Company. Into a 16 ounce (454 grams) aerosol dispenser there is filled 248 grams of the described composition, less the propellant, and the dispensing valve thereof is staked in place, sealing the dispenser. Then, 187 grams of a mixture of the described propellants in a 3:2 ratio of Propellant 12 to Propellant 114 are backfilled in gas form through the dispensing valve into the container. The propellants employed are Freons 12 and 114, sold by E. I. DuPont de Nemours & Company, Inc. The container is then shaken, producing the desired pressurized emulsion or dispersion therein. The product is ready for use immediately but is normally packed, sent to storage, shipped and sold at retail before use. In such case, it is labeled to direct shaking thereof before use to avoid any possible stratification of active ingredients and consequent inconsistent discharges of such components.

A mixed load of laundry, including cotton, 40:60 and 35:65 cotton-Dacron blends, nylon, polyester, acrylic and acetate fabrics, with about one-half of the load being cotton, about one-quarter being cotton-Dacron and the other one-quarter being a mixture of the other types of fabrics, is washed in an automatic home washing machine of the vertical agitator type, using a synthetic organic detergent composition based on linear higher alkyl benzene sulfonate and nonionic detergent built with sodium silicate, rinsed and spun dried. Eight pounds (dry basis) of the washed and spun dried laundry, which contains 40 to 80% moisture, are then added to a horizontal axis automatic laundry dryer wherein the drying air is heated electrically to a temperature of about 70° C. at the inlet. The dryer rotates at about 20 revolutions per minute and the drum thereof is equipped with internal flights to cause tumbling movements of laundry being dried.

Before starting rotation of the dryer drum there is discharged into the interior thereof from the described pressurized container a sufficient quantity of stable softening foam to soften the laundry and render it static-free. Such quantity is about 20 grams and initially forms a foam approximately spherical in shape and of a diameter of about ten centimeters. This foam, if allowed to remain without contact with other than a supporting member, maintains its shape almost indefinitely with only slight contraction as it dries out. However, with the inception of drying and tumbling the foam is reduced in size so that after five minutes it has disappeared, with the components thereof, except for the gases and volatile constituents, such as water, being distributed over the laundry which had come into contact with it. Yet, after thirty seconds and sometimes after three minutes of tumbling more than 10% of the foam is still in recognizable spherical form.

After the discharge of the softening composition, in stable foam form, into the dryer, which previously has the damp laundry therein, within thirty seconds the drying cycle is begun and continues for 45 minutes, with the nylon, acetate, acrylic and polyester materials being removed after about 10 minutes and the cotton-Dacron blends being removed after 20 minutes and with any of those materials which are not sufficiently dried at such times being charged back to the dryer after forty minutes. At the end of the drying process cool air is admitted to the dryer and tumbling is continued for an additional three minutes, after which the laundry is removed and examined for softness, anti-static properties, etc.

The dried laundry is noticeably softer than control laundry similarly dried but without the addition of the present softening composition. It is also more static-free and is superior in this respect to other such laundry. There are no objectionable stains or oily or greasy spots on the laundry, even on test swatches of light blue cotton-Dacron fabrics on which such stains normally are most readily observable. Thus, the softening composition is a satisfactory one for use in the automatic laundry dryer or similar apparatuses and in similar processes.

When the same experiment is repeated except for the coconut oil fatty alkyl dimethyl glycine being replaced by coconut oil fatty acids amidopropyl dimethyl glycine, essentially the same type of good softening results. Similarly, when the triethanolamine stearate is replaced by an equal mixture of such stearate and sodium stearate the foam produced is a stable one and is effective in the described softening operation. Other changes that may be made without significantly adversely affecting the compositions' desired softening and other treatment properties are replacement of glycerol with propylene glycol or a polyethylene glycol, and replacement of lauric myristic diethanolamide with other higher fatty acid diethanolamide, such as lauric diethanolamide, palmitic diethanolamide and lauric myristic monoethanolamide or a mixture of these. In further changes of the formulation the coconut oil fatty alkyl dimethyl glycine or coconut oil fatty acid amidopropyl dimethyl glycine is replaced by lanolin, hydrophilic lanolin derivative (Solulan or Acetulan of the types described in the specification) or polyethylene or a mixture of equal parts thereof and good softening and distribution of the softening agents results. Such is also the case when the proportions of the various components are changed ±20% and ±10%, within the ranges previously given, while maintaining a balance thereof so that the conditioning foam is a stable one.

When the dryer operation conditions are changed, so that drying is effected at temperatures over the range of 50° to 80° C., e.g., 50°, 65° and 80° C., and drying times are adjusted to over the range of 10 minutes to one hour, e.g., 10, 30 and 60 minutes (inversely proportional to the temperature), equivalent softening effects will result. This is also the case when the moisture content is adjusted, within the range of 15 to 50%, e.g., 20%, 40% and 45% and when the halogenated hydrocarbon propellants are replaced by a mixture of isobutane and propane of equivalent pressure or when the discharge pressure is varied within the 10 to 100 lbs./sq. in. g. range, e.g., 20, 40 and 80 lbs./sq. in.g.

In some experiments the diethanolamide and humectant are omitted from the formula and while anti-static action may be noticeably diminished and the foam may not be as resilient and capable of withstanding breakdown in the dryer, nevertheless the softening effects are still useful and the product is classifiable as a stable foam. When water, soap and the softening agent (the glycine compound) are also omitted from the formula, so that all that remains is conditioning agent and propellant system (liquefied gas propellants are employed, in which the conditioning agent is soluble or readily dispersible and when the proportions of conditioning agent and propellant are adjusted so as to have about 5 to 10% of conditioning agent therein, a foam or honeycomb type of product may be made which can be employed in the dryer or otherwise as a source of conditioning compound for laundry or fabrics. Of course, such a product, without the additional softening, humectant, foaming (also softening), anti-static and dispersing components present, will be inferior in the properties of such components to the compositions described elsewhere in this example. However, foams of the conditioning agents alone or with inert carriers may be useful in combination treatments with foams made of the other components of the present compositions and they supply means for adjusting the content and proportion of conditioning or leveling agent in the drying-treating operation (by adjusting proportions of the different types of foams employed).

In all the above formulations, for aesthetic effects, 0.001 to 5%, preferably 0.1 to 1% of perfume may also be employed.

In an alternative formulation the proportion of fill and propellant are 50:50 and the total fill weight is 340 grams in a 12 oz. container. Results are like those for the 57:43, mixes described but the foam is not as strong and stable.

EXAMPLES 2–8

The compositions of Example 1 are made with the following materials being substituted for the polyvinyl pyrrolidone:

EXAMPLE 2

PVP/VA

EXAMPLE 3

Gafquat 755

EXAMPLE 4

EMA 1325

EXAMPLE 5

Gafac ACRS 610

EXAMPLE 6

Gafac RO 310

EXAMPLE 7

PEI (polyethylene imine, Dow Chemical Co.)

EXAMPLE 8

HAPU (aminopolyurea, Hercules Chemical Co.)

The identifications of the various trademarked products of the preceding examples were given previously in the specification. Molecular weights of the products given are within the ranges previously mentioned and will usually be in the 1,000 to 5,000 range, e.g., 2,000.

The compositions described are employed in the manner previously related in Example 1 for those based on polyvinyl pyrrolidone as the conditioning agent. Although, compared to the products resulting from the processes of Example 1, there are differences, in all cases the softening effects obtained are satisfactory and the conditioning compounds contribute usefully to the conditioning or leveling effects. Thus, all the named conditioning polymers are considered to be satisfactory and desirable components of such softening and anti-static fabric treating compositions.

EXAMPLE 9

The compositions of Examples 1–8 are made but with distearyl dimethyl ammonium chloride being employed as a softening agent instead of the glycine compounds or other described softeners and with the proportion thereof reduced to 3%. The formulations of the compositions are adjusted by increasing the moisture contents to 39.9%. No objectionable staining is noted and it is considered that the conditioning agents present help to prevent such staining due to their leveling effects. In further variations of this example the cationic softening agent is changed to benzethonium chloride, cetyl trimethyl ammonium bromide and dilauryl dimethyl ammonium chloride and to equal mixtures thereof, with the total proportions being 1, 2, 3 and 4%. In such cases softening of the mixed laundry results and this is also the effect when the materials treated are specific types of the mentioned fabrics and are treated separately. Some slight staining of test fabrics may be observed at the higher concentrations of the cationic softener but it is clear that the conditioning or leveling compound present, especially when the concentration thereof is about 2 or 3%, exerts a desirable effect, diminishing the extent of staining and often preventing it despite the presence of such fairly high proportions of cationic softener.

EXAMPLE 10

The various conditioning agents described in Examples 1–9 are deposited on polystyrene foam substrates in the forms of balls so that the surfaces thereof have coatings of the conditioning agents about one millimeter thick, with the balls being large enough so that 0.1, 0.2, 0.5 and 1 gram of leveling agent are available for depositing on the laundry of an eight pound automatic laundry dryer load. The balls are added to such dryer loads (separately) and the conditioning of laundry after drying is better in each case, with softening being observable. However, even better effects are obtained when the compositions of Examples 1–9 are deposited on the polystyrene foam substrates in sufficient quantities so as to have amounts equivalent to the amounts applied in Examples 1–9 abraded or rubbed onto the surfaces of the tumbling laundry. (Of course, in such cases, the propellant and water will be omitted, except for a slight plasticizing amount of water). In such instances the treated laundry, onto which the conditioning composition has been applied during tumbling thereof in the dryer, is satisfactorily softened, without objectionable staining, and the leveling or distributing effects of the polymeric components are noticeable.

Similar results obtain when the conditioning agents and compositions are applied to other substrates, such as paper, sponge (cellulose or polyurethane), wood and other foamed or solid plastics and when similar polymeric conditioners are employed. The coated substrate is allowed to tumble with the laundry in the dryer or is affixed to a dryer part so that the laundry makes repeated contacts with it during tumbling.

The invention has been described with respect to examples and illustrations thereof but is not to be limited to these because it is evident that one of ordinary skill in the art, with the present description before him, will be able to utilize substitutes and equivalents for the various components and steps of the invention without departing from the spirit thereof.

What is claimed is:

1. A fabric conditioning composition in a pressurized dispensing container adapted to produce a foam when dispensed comprising, by weight 0.2 to 10% of a conditioning agent having a molecular weight in the range of 500 to 10,000 and selected from the group consisting of polyvinyl pyrrolidone, vinyl pyrrolidone-vinyl acetate copolymers, quaternized vinyl pyrrolidone copolymers, polyethylene maleates, complex polyethoxy phosphate esters, polyethylene imines, amino polyureas, and cationic polyglycosides and mixtures thereof, 1 to 25% of softening agent selected from the group consisting of betaines, quaternary ammonium salts, lanolin, lanolin derivatives and polyethylenes and mixtures thereof, 0.5 to 10% of an anionic or nonionic detergent foaming agent or a mixture thereof, 0.2 to 3% of foam stabilizer comprising higher, $C_{10}$–$C_{20}$ fatty acid lower, $C_1$–$C_4$ alkanolamide, 0.5 to 10% of humectant, 10 to 60% of water and 10 to 80% of liquefied gas propellant.

2. A composition according to claim 1 wherein the betaine softening agent is a higher fatty alkyl dimethyl glycine or a higher fatty acid amidopropyl dimethyl glycine and is 8 to 20% by weight of the composition, the anionic detergent foaming agent is a stearic acid soap and is 1 to 5% by weight of the composition and there are present 0.3 to 3% by weight of the conditioning agent, 15 to 50% by weight of water and 30 to 70% by weight of liquefied gas propellant.

3. A composition according to claim 2 wherein the conditioning agent is polyvinyl pyrrolidone.

4. A composition according to claim 2 wherein the conditioning agent is a polyvinyl pyrrolidone-vinyl acetate copolymer.

5. A composition according to claim 2 wherein the conditioning agent is a quaternized vinyl pyrrolidone copolymer.

6. A composition according to claim 2 wherein the conditioning agent is a polyethylene maleate.

7. A composition according to claim 2 wherein the conditioning agent is a complex polyethoxy phosphate ester.

8. A composition according to claim 2 which comprises, by weight 0.5 to 2% of conditioning agent, 10 to 15% of coconut oil alkyl dimethyl glycine softening agent, 1 to 5% of triethanolamine stearate soap, 1 to 5% of glycerine humectant, 0.5 to 1% of lauric myristic diethanolamide foam stabilizer, 20 to 40% of water and 40 to 60% of a mixture of halogenated hydrocarbon propellants dichlorodifluoromethane and dichlorotetrafluoroethane.

9. A composition according to claim 8 wherein the conditioning agent is a polyethylene imine.

10. A composition according to claim 8 wherein the conditioning agent is an aminopolyurea.

11. A composition according to claim 8 wherein the conditioning agent is a cationic polyglucoside.

* * * * *